United States Patent [19]

Hasegawa et al.

[11] 4,103,833

[45] Aug. 1, 1978

[54] YARN WINDING APPARATUS

[75] Inventors: Katsumi Hasegawa, Kusatsu; Akio Ando, Otsu; Chikayasu Yamazaki, Kyoto; Morio Okada, Nishinomiya; Norihiro Aoi, Okazaki; Nobuhiko Tanbara, Kyoto, all of Japan

[73] Assignee: Toray Industries, Inc., Tokyo, Japan

[21] Appl. No.: 688,921

[22] Filed: May 21, 1976

[30] Foreign Application Priority Data

May 29, 1975 [JP] Japan ..... 50-64763
May 29, 1975 [JP] Japan ..... 50-64766
May 29, 1975 [JP] Japan ..... 50-64768

[51] Int. Cl.[2] ..... B65H 54/02; B65H 67/04

[52] U.S. Cl. ..... 242/18 A; 242/18 R; 242/18 DD; 242/46.4

[58] Field of Search ..... 242/18 A, 18 DD, 18 R, 242/25 A, 46.2, 46.3, 46.4, 46.6, 72 R, 72.1

[56] References Cited

U.S. PATENT DOCUMENTS

| | | | |
|---|---|---|---|
| 2,772,054 | 11/1956 | Herele et al. | 242/18 A |
| 2,978,194 | 4/1961 | Lloyd et al. | 242/25 A |
| 3,495,781 | 2/1970 | Graf et al. | 242/46.4 |
| 3,561,688 | 2/1971 | Hagihara et al. | 242/18 A |
| 3,701,491 | 10/1972 | Brown | 242/46.4 X |
| 3,779,472 | 12/1973 | Boggs | 242/46.4 X |
| 3,841,574 | 10/1974 | Lenk et al. | 242/18 A X |
| 3,977,616 | 8/1976 | Owens et al. | 242/18 DD X |

FOREIGN PATENT DOCUMENTS

| | | | |
|---|---|---|---|
| 45-34420 | 11/1970 | Japan | 242/18 A |

*Primary Examiner*—Stanley N. Gilreath
*Attorney, Agent, or Firm*—Miller & Prestia

[57] ABSTRACT

In a yarn winding apparatus, yarn is fed from a spinning frame or the like at high speed, and is wound on bobbins. Shifting of yarn from a full to an empty bobbin is carried out smoothly. A plurality of bobbins is fitted on a revolving arm, and each individual bobbin is positively driven from an independent power source.

A plurality of independent drives are installed on the back of the revolving mechanism and bobbins are fitted on its front. Intermediate shafts are installed concentrically with a rotatory shaft which is a part of the revolving mechanism, and pass through the revolving mechanism. Rotary power is transmitted from each independent drive to each individual bobbin by these intermediate shafts.

7 Claims, 16 Drawing Figures

YARN WINDING APPARATUS

BACKGROUND OF THE INVENTION

The present invention relates to an improved yarn winding apparatus of the revolving type, which ensures unfailing winding of yarns which are fed continuously at high speed. The yarns are taken up on bobbins and the winder facilitates shifting of yarn from a full bobbin to an empty bobbin.

In operation, yarns are fed continuously on bobbins as in the process of spinning or of drawing synthetic fibers. It is a problem to smoothly shift a yarn from a full bobbin to an empty one. If this operation is not properly performed large amounts of waste yarns are produced, and interruptions are encountered.

A typical yarn shifting operation might include two winders, installed side by side, so as to arrange the bobbins of the winders in a straight line. When the bobbin on one of the two winders becomes full, an operator manually shifts the yarn to an empty bobbin on the other winder. However, it is necessary to provide two winders for each spinning frame. Further, a larger space is needed to arrange the bobbins as above, and this makes the necessary equipment rather expensive.

In order to remedy such drawbacks as mentioned above, a different type of winder, the so-called "revolving" winder, has been suggested. A plurality of shafts is fitted into a rotatory body, and when a bobbin becomes full of yarn, the rotatory body is revolved so as to shift the yarn to a new empty bobbin on which it is to be wound. A spindle drive revolving winder, for example, as disclosed in Japanese Patent Publication No. 3488/1966, is, in particular, looked upon as promising for operations at higher speeds in the future.

In the above mentioned revolving winder, however, a motor is positioned at an end of the spindle which supports the bobbin, and the spindle is driven directly by the motor. The structure is such that the motor is fastened to the rotatory body; therefore the equipment is inevitably accompanied by shortcomings.

Namely, in order to drive the spindle at higher speed, it is necessary to use a corresponding larger motor. As the size of motor becomes larger, the whole equipment necessarily becomes larger. If, on the contrary, the winding equipment is designed in a smaller size, there is naturally a limitation on the speed of rotation of the spindle.

Further, when a motor is fastened to the rotatory body, there arises the necessity of providing a slip ring for the supply of electricity for driving it. Still further, with decrease in the diameter of the bobbin, so that it will have the desired geometry to take up a larger amount of yarn, it becomes more difficult to fix the motor in a chuck.

In effect, with the revolving type yarn winding apparatus wherein the spindle is driven directly by a motor, there are many practical limitations on its structural design.

OBJECTS OF THE INVENTION

An object of the present invention is to provide a novel yarn winding apparatus which is simple in structure and which makes it possible to scale the equipment down to smaller size.

Another object of the invention is to provide an apparatus for winding yarns having a novel device for shifting yarn from a full bobbin to a new, empty bobbin.

A further object of the invention is to provide a novel apparatus for winding yarns having a mechanism whereby the removal of full bobbins and the fitting of empty bobbins are facilitated.

Still further objects of the present invention will be clarified by the following detailed descriptions, with reference to the accompanying drawings, as hereinafter set forth.

DETAILED DESCRIPTION OF THE DRAWINGS

Figure 1:
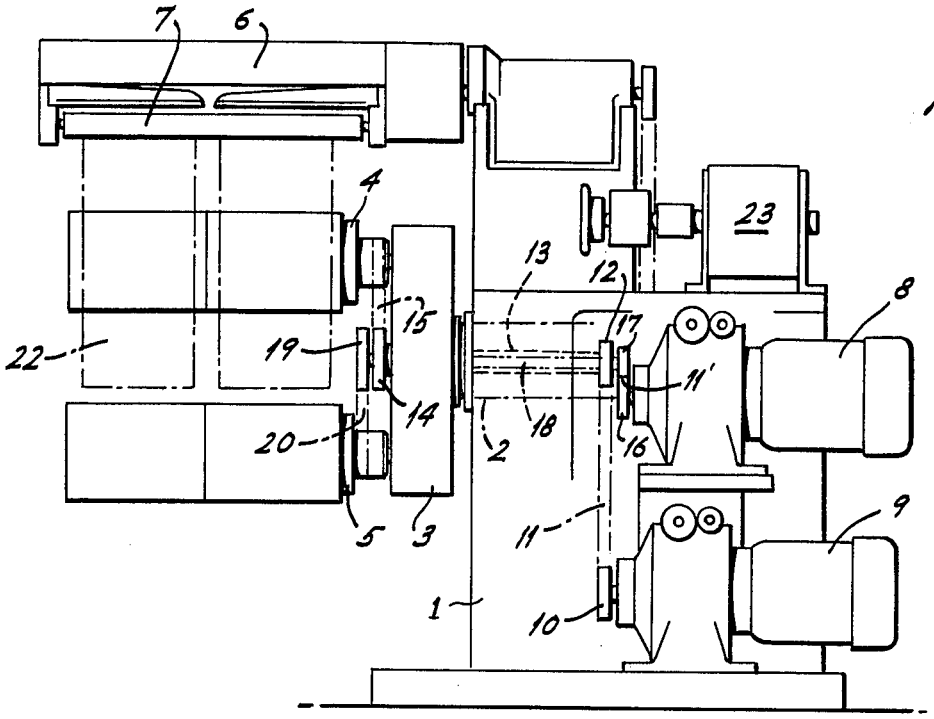
FIG. 1 is an elevational view of a yarn winder made in accordance with the present invention, showing its construction.
Figure 2:
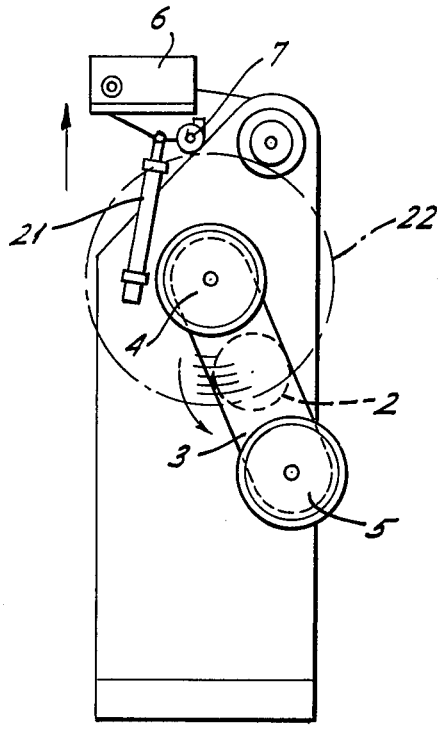
FIG. 2 is a side view of same.

Referring to the drawings, FIGS. 1 and 2 respectively represent elevational and side views of a yarn winder in accordance with the present invention. In these Figures, 1 designates a frame of the yarn winder, in which is set a revolving mechanism consisting of a revolving spindle 2, which is rotatably supported by its bearings on said frame, and a revolving arm 3 which is rigidly mounted on an end of said spindle. To said revolving arm 3, on the front of the revolving mechanism, is affixed a plurality (two in the case of the embodiment of the invention as illustrated) of spindles (4 and 5 as illustrated) for supporting the bobbins. The number 6 indicates a traverse motion, 7 designates a touch-roller and 8 and 9 are motors with speed variable mechanisms, for driving the spindles 4 and 5.

Power from a pulley 10 attached to the motor 9, which is affixed to the back of revolving mechanism, is transmitted to the spindle 4 by way of a belt 11, a pulley 12, an intermediate shaft 13 installed through the revolving mechanism, a pulley 14 and a belt 15.

Power from a pulley 16 attached to the other motor 8 is transmitted to the spindle 5 by way of a belt 11', a pulley 17, an intermediate shaft 18 which extends concentrically through the aforesaid intermediate shaft 13, a pulley 19 and a belt 20.

The aforesaid traverse motion 6 is so designed as to change its position along with an increase in the diameter of the package 22. Its pressure on the package is regulated by the action of a cylinder 21 installed on the frame 1.

The number 23 indicates a rotary actuator, by the action of which the revolving spindle 2 is rotated, thereby to shift bobbins positioned on the spindles 4 and 5 provided on the revolving arm 3.

Figure 3:
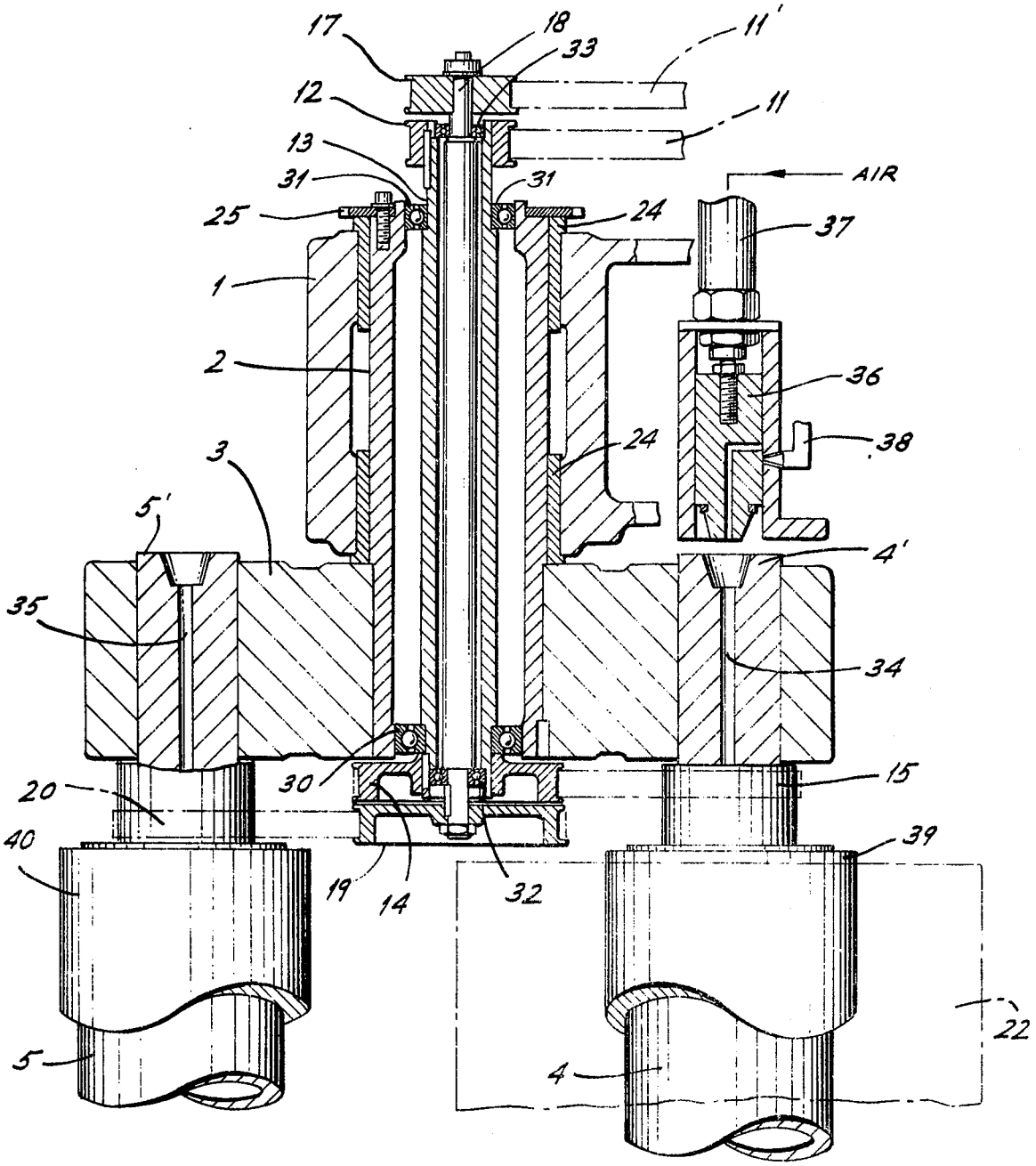
FIG. 3 is a sectional view taken on line X—X of FIG. 2.

With reference to FIG. 3, principal parts of the yarn winder in accordance with the present invention, and their action, will be described. The revolving spindle 2 is rotatably supported by a bearing 24 provided in the frame 1; it is rotated through a predetermined angle by driving a sprocket wheel 25 provided at one of its ends, by use of the rotary actuator 23 (FIG. 1).

The aforesaid revolving spindle 2 is a hollow shaft, and through it is provided the intermediate shaft 13, which is also hollow, with bearings 30 and 31 supporting it. Further, inside this intermediate shaft 13, by bearings 32 and 33, the intermediate shaft 18 is supported concentrically with the axis of the revolving spindle 2. In effect, the apparatus is so designed that, by driving these intermediate shafts 13 and 18 from the belts 11 and 11', the spindles 4 and 5 are driven independently of each other.

Said spindles 4 and 5 are supported by dead axles 4' and 5' which are fastened to the revolving arm 3. As will be seen from FIG. 3, these dead axles 4' and 5' are provided with bores for air supplies 34 and 35; and it is so arranged that, after bringing a nozzle 36 into close contact with the end of one of the bores by the use of a cylinder 37, air is supplied through a tube 38 to release the chuck provided in the spindle 4 or 5, thereby to hold or remove a bobbin 39 or 40.

One of the characteristics of the present invention resides in the fact that the revolving spindle 2, for driving the revolving arm 3, is a hollow shaft. Inside this hollow shaft the intermediate shafts 13 and 18 are provided, concentrically with the revolving axis of the spindle 2. These intermediate shafts are driven by the motors 8 and 9, independently of each other, thereby to drive the spindles 4 and 5 independently of each other.

Although in the apparatus as illustrated in FIG. 3, the spindles are supported by the dead axles 4' and 5', the design is not limited to this specific arrangement, but may as well be such that the spindles 4 and 5 are supported by bearings provided in the revolving arm 2. Even in this instance, however, the spindles 4 and 5 are to be supported at one end only. It is not desirable to support them at both ends, because it is then necessary to take out a bearing from either end of the spindle when removing a full bobbin or holding an empty one, causing corresponding time lags and also giving rise to the necessity for a centering operation. This naturally makes the operation that much more complicated.

An apparatus for winding yarns made in accordance with the present invention, by virtue of the novel design of the structure as described, has the following and other advantages, viz.:

(A) The spindles 4 and 5, and the motors 8 and 9 for driving them, are installed separately; and it is possible to affix the motors rigidly to the frame 1, etc.

(B) In contrast with the conventional type of winder wherein the spindles are directly driven, it is possible to select the motors in such sizes as are desired.

(C) Since the motors are not fastened to the revolving arm 3, it is possible to supply electricity without using a slip ring; so the power supply equipment is simplified and an unfailing supply of power is ensured. Further, since slip rings are not used, the construction of the apparatus is very much simplified.

(D) Since the spindles are driven through intermediate shafts provided through the revolving mechanism, the diameter of the revolving spindle can be determined irrespective of the distance from the axis of the revolving spindle to the spindles 4 and 5. Accordingly, it is possible to make the entire apparatus smaller in size. In this connection, reference is made to Japanese Patent Publication No. 3488/1966.

We shall now proceed to an explanation of the yarn winding apparatus equipped with a yarn shifting device.

Figure 4:
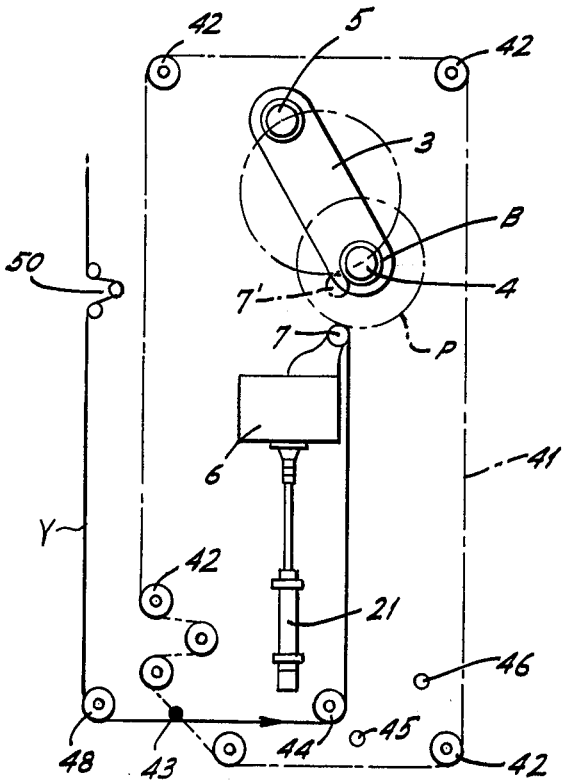
FIG. 4 is a front view of the principal parts of the yarn winder equipped with a yarn shifting device.

FIG. 4 is a schematic front view of the principal parts of a revolving winder. On the revolving arm 3, which is rotatably supported at its center, are disposed spindles 4 and 5, upon which bobbins are supported.

The number 6 indicates a traverse motion, and 7 designates a touch-roller attached to the traverse motion. The latter is in touch with the surface of a package P which is being formed on a bobbin B, and is rotated by rotation of the package P. The pressure which this traverse motion 6 applies to the surface of the package is regulated by the action of a cylinder 21 provided underneath it, and the touch-roller 7 is free to move from the position 7' to 7.

Surrounding the aforesaid spindles 4 and 5, etc., and the traverse motion 6, there is provided a chain 41, which is supported by a plurality of sprockets 42, and the chain is actuated by positively driving one of the sprockets. On this chain 41 is provided a travelling guide 43, which moves with the motion of the chain 41 along its predetermined course.

The numeral 44 indicates a guide serving as the fulcrum for traversing of the yarn Y, which is delivered under the aforesaid touch roller 7 in the yarn path as shown in FIG. 4. The yarn starts traversing as soon as it leaves this fulcrum guide, thereby forming the package P. Guides 45 and 46 are used only at the time of shifting the yarn.

Figure 5:
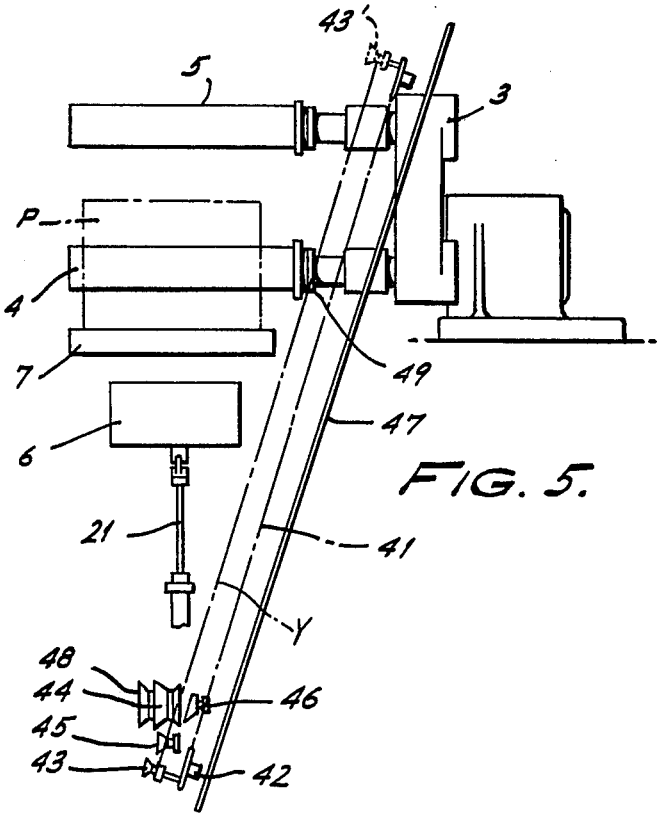
FIG. 5 is a side view of the parts shown in FIG. 4.

FIG. 5 is a schematic side view corresponding to FIG. 4. Except for the parts where the spindles 4 and 5 revolve and where the traverse motion 6 is positioned, a supporting board 47 is provided aslant, and on this supporting board are fitted the chain wheel 42, the traverse fulcrum guide 44 and the guides 45, 46 and 48.

Furthermore, the apparatus is so devised that, when the travelling guide 43 has moved along the course of the chain 41 and has reached the position 43' above the spindle 5, a yarn Y which has been led by this travelling guide 43' passes across the circle of rotation of a yarn catch 49 provided at an end of a bobbin resting on the spindle 4 (or 5).

Figure 6:
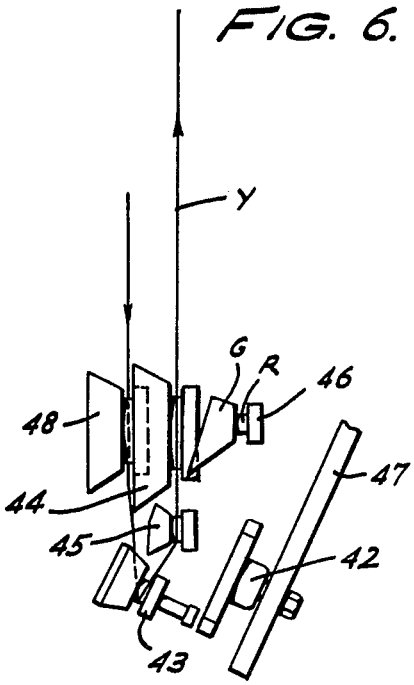
FIG. 6 is a side elevation showing the relative position of guides in an important part of the yarn shifting device.

FIG. 6 shows the relative positions of the guide rollers as well as examples of their shapes. Their positions are so arranged as to zigzag along the course of the yarn so that the yarn may follow, with the movement of the travelling guide 43, a predetermined path which will be described further hereinafter. Further, each roller is provided with a guide device for guiding the yarn along the desired path.

From the following description with reference to FIGS. 7A to 7G, it will be apparent how a yarn is shifted according to the present invention.

A yarn Y, which has been spun out of a spinning frame (not illustrated), passes through a tension compensator 50 and runs by way of the guide 48 and the traverse fulcrum guide 44, and is wound on a bobbin B held on the spindle 4. When this bobbin B becomes full, a shift is signaled, by such means as a timer, from the control board of the winder.

At this stage of the winding operation, the position of the travelling guide 43 is above that part of the yarn Y which hangs between the guide roller 48 and the traverse fulcrum guide 44. (This position will hereinafter be referred to as the "standby position".). (See FIG. 7A).

When a shift is signaled by the control board of the winder, (not illustrated), the chain wheel 42 is driven and the chain 41 moves in the direction shown by the arrow and catches the yarn Y.

When the travelling guide 43 advances further, the yarn Y leaves the guide 44 and is taken into the package P, traversing on the fulcrum of guide 45. (See FIG. 7B).

Figure 7A:
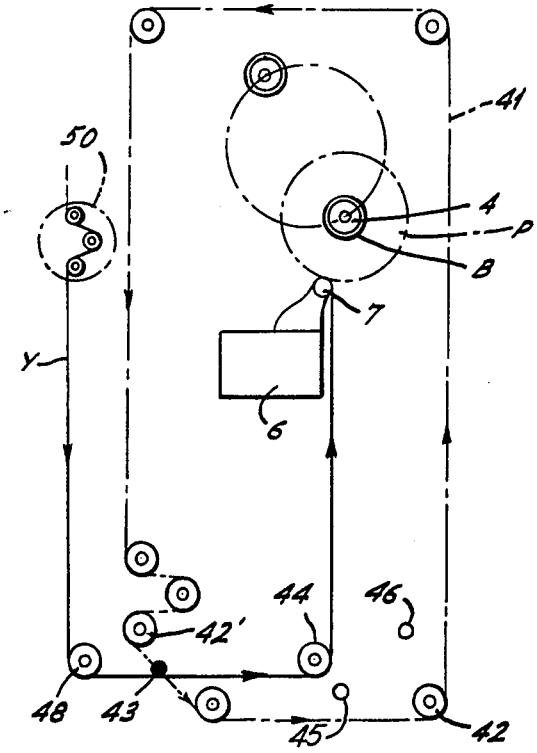
FIGS. 7A to 7G are front views of a yarn shifting device of this invention, showing how it operates to shift a yarn.
Figure 7B:
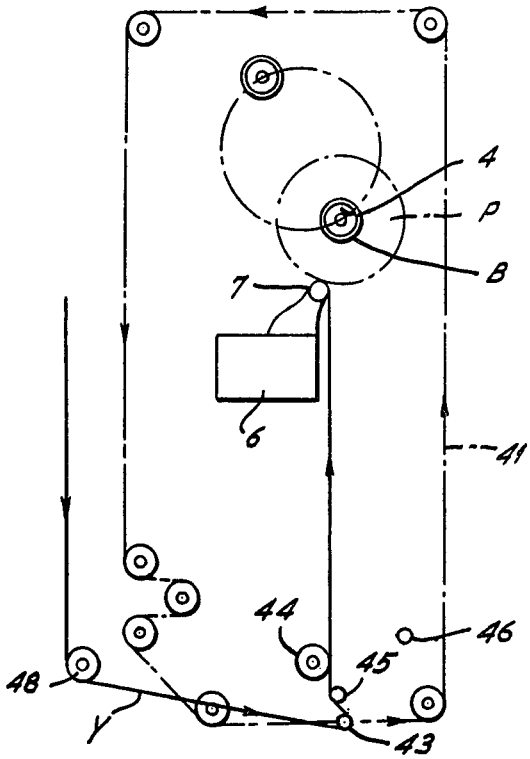
Figure 7C:
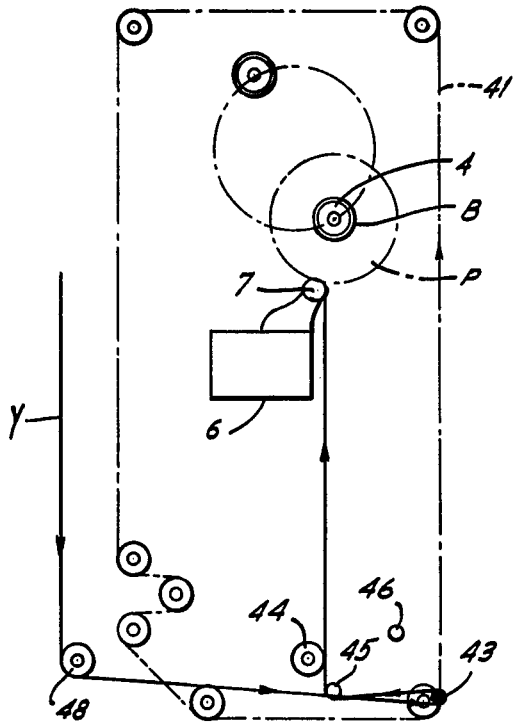

When the travelling guide 43 advances still further, the yarn follows the path shown in FIG. 7C. However, the positions of the guide 48, travelling guide 43, guide 45 and traverse fulcrum guide 44 are staggered as shown in FIG. 6. Accordingly, the guide 45 does not catch the yarn Y which is supplied to the travelling guide 43 but catches only the yarn Y which is delivered from the travelling guide 43.

Figure 7D:
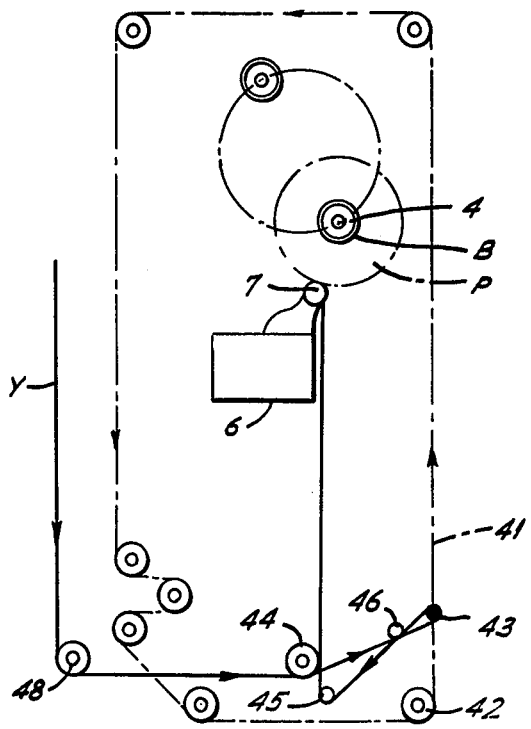

The travelling guide 43 continues to move. When the stage shown in FIG. 7D is reached, the yarn Y coming from the travelling guide 43 touches the guide 46 and is then taken into the package P by way of the guide 45. The path of the yarn Y at this stage is: guides 48 → 44 → travelling guide 43 → guides 46 → 45 → package P.

Figure 7E:
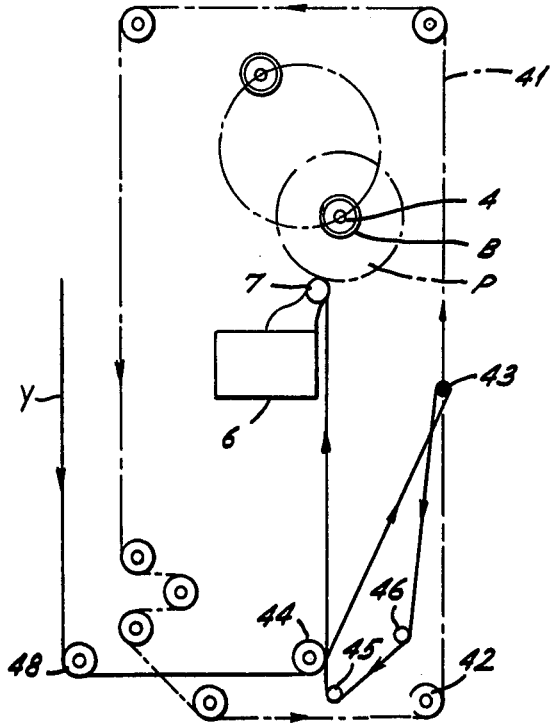
Figure 7F:
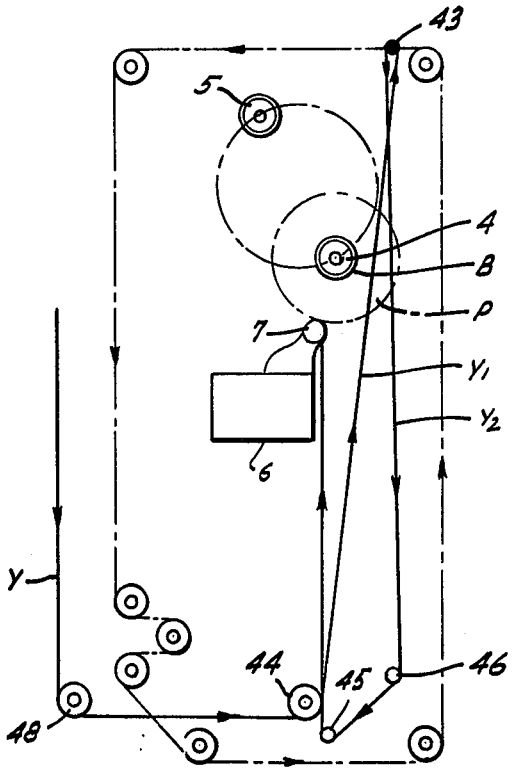

The travelling guide 43 continues to move still further and passes by the side of the bobbin B as shown in FIG. 7E, and then it reaches a position above the revolving arm as shown in FIG. 7F. When the yarn Y approaches the bobbin B, the revolving arm 3 is actuated and rotates clockwise. At this time, the spindle 5 on which an empty bobbin is mounted has already started its preliminary run. After the revolving arm 3 has turned by 180° to the position illustrated in FIG. 7G, the empty bobbin is already up to normal speed for its winding operation.

Therefore, after the revolving arm 3 has made its turn, the spindle 5 is positioned at the same place where the package P was previously forming, and the empty bobbin is ready for taking up yarn.

Figure 7G:
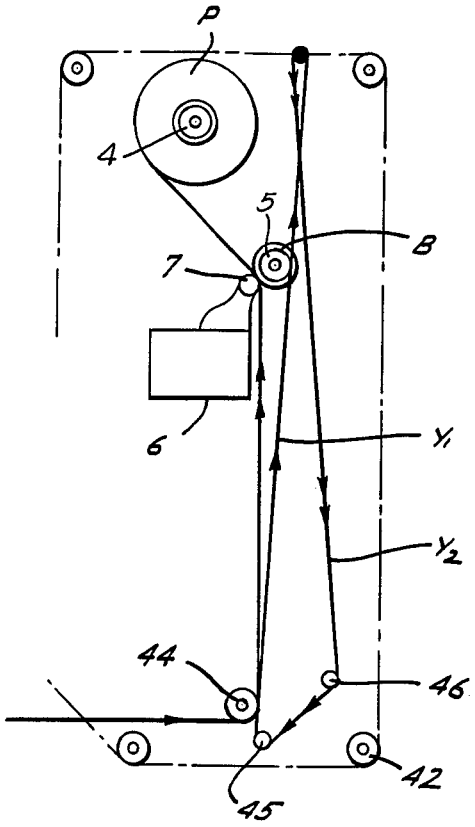
Figure 8:
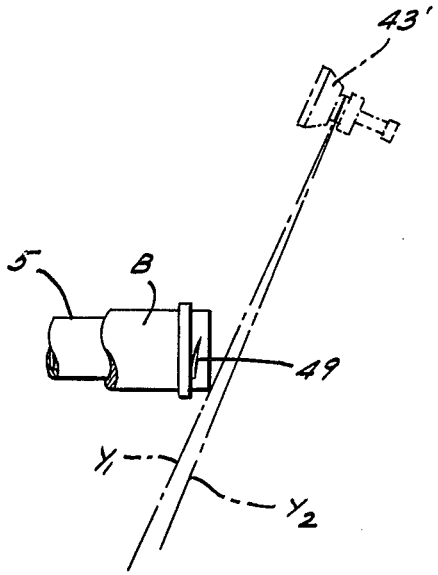
FIG. 8 is a side view of the same, illustrating how a yarn is shifted from a full to an empty bobbin.

When the travelling guide 43 advances still further to the position shown in FIG. 7G, the yarn $Y_1$ which is being fed into guide 43 is caught by the yarn catch 49 of the bobbin B shown in FIG. 8. At this time the yarn $Y_2$ of FIG. 8 which runs through the guide 43, is directed toward the guide 46, so it is not caught by the yarn catch 49.

The yarn $Y_1$ which was caught by the yarn catch 49 shown in FIG. 8 is cut off the yarn $Y_2$ and is wound on the new bobbin B, because of its rotation.

On the other hand, the yarn $Y_2$ which is still being wound on the package P of the bobbin B held on the spindle 4 (FIG. 7G) is wound all the way to the end of the yarn which was cut off in the aforesaid process.

As will be seen from the foregoing description and particularly from FIGS. 6 and 8, the guide 46 is so designed and positioned that it leads the yarn $Y_1$, running out of the travelling guide 43, namely, the yarn $Y_1$ which is fed into the package P toward the far side of the bobbin. When the traversing yarn is shifted to an end bobbin, the yarn catch 49 contacts and catches only the yarn $Y_1$ which is positioned on the feed side, and does not contact yarn $Y_2$ of FIG. 8.

Further, the traverse fulcrum guide 44 and the guides 45, 46 and 48 are each composed, as illustrated in FIG. 6, of a fixed, conical guide part G and a rotatory part R, in order that they may function smoothly in the yarn catching operation illustrated in FIGS. 7A to 7G. Besides, their positions are staggered along the path of yarn, to make it possible to form the yarn paths as are necessary for shifting the yarn as heretofore described.

Although a chain has been shown and described as a means of moving the travelling guide 43, it will be appreciated that a V-belt or other flexible material may be used. Further, although a design in which the travelling guide goes around the winder has been specifically described, it is not always necessary to make the travelling guide go all the way around. Other designs may be adopted, in keeping with the principles of this invention, as will be understood.

The guides consisting of guide part G and rotatory part R, as illustrated in FIG. 6, have been specially designed so that they catch only the yarn running out of the travelling guide 43 as it passes along a specific path; as long as guides of such construction are employed, it is not necessary to provide any special mechanism to cause said guides to make specific movements forward and backward. However, guides of ordinary construction, which are so designed as to move in concert with the movement of the travelling guide 43, may be substituted.

As for the revolving winders to be used, those having two spindles are in many cases preferred.

Any yarn catch 49 is adequate, so long as it is capable of catching and of cutting the yarn by rotation of the spindle. Generally, it is advisable to use a metal claw which has an opening extending in the direction of revolution of the bobbin.

One of the advantageous characteristics of the present invention is that there is provided, in a revolving type winder, a traverse fulcrum guide, and also a travelling guide which moves along the exterior of the winder, to lead the yarn to the yarn catch automatically; from these features of the invention the following advantages are realized:

(A) Since a revolving type winder is used, the whole structure of the winding machine may be made much smaller.

(B) Since a revolving type winder is used, a continuous winding operation is possible and no waste yarn is produced. The apparatus is suitable for high-speed operation, and has high productivity.

(C) Since the yarn shifting operation is unfailingly reliable, no abnormality of winding on the surface of a package is experienced.

(D) In the yarn shifting operation according to this invention, it is possible to lead a yarn to an end of the bobbin and to have it caught by a yarn catch provided on the bobbin or on the bobbin chuck, so that it is possible to wind yarns of larger deniers, with shifting of yarns, continuously.

(E) In the yarn shifting device according to the invention, before the travelling guide 43 with a running yarn Y held in it reaches the yarn shifting position, the yarn touches the fixed guides 45 and 46. The running yarn is returned by the travelling guide 43, and is led along a different path in which it is fed into and sent out from the travelling guide 43. Therefore, the shifting of yarn is accomplished with certainty. Further, the running yarns never touch each other while the travelling guide 43 is in motion, and essentially no defective yarn is produced.

Figure 9:
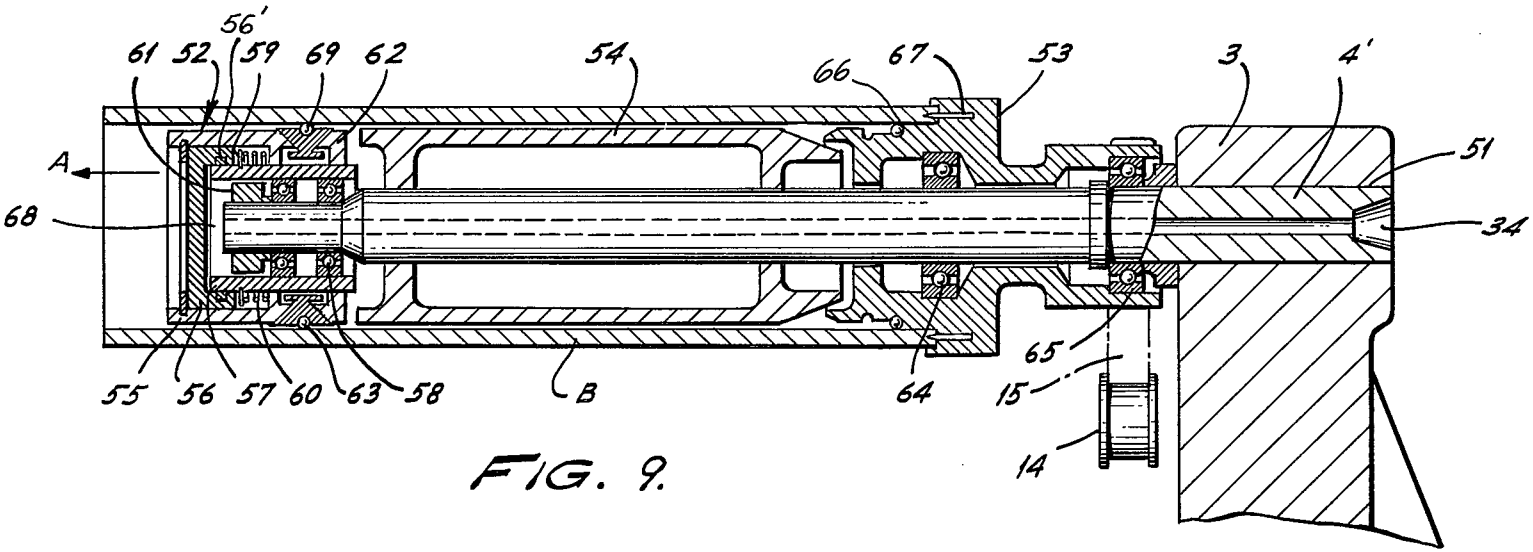
FIGS. 9 and 10 are traverse sectional views of a bobbin supporter, showing details of its structure.

FIG. 9 is a transverse sectional view of an example of the bobbin-supporting device in accordance with the present invention.

The numeral 3 indicates the revolving arm of the winder. Into a hole 51 provided at its end is fastened an end of a dead axle 4'.

At the free end of said dead axle 4' is provided a supporting means 52, and at its root a supporting means 53. Between the two supporting means 52 and 53 is provided a guide means 54.

The supporting means 52 is composed of a cylinder 55 and a stopper 56 which stops its opening. Thus, stopper 56 functions as a kind of piston. Inside this stopper 56 is provided a cylinder 57, supported in a bearing 58 by the aforesaid dead axle 4'. Cylinder 57 and stopper 56 are sealed by an O-ring 56'. To the exterior of this cylinder 57 is fastened a snap ring 59, and between this snap ring 59 and the cylinder 55 a spring 60 is provided. Further, the end of the dead axle 4' is provided with a sealing means 61. By virtue of sealing means 61 the cylinder 55, stopper 56 etc., form a closed fluid-tight chamber. An end of the cylinder 57 is provided with a cam 62. By cam 62 and the slope formed at an end of the aforesaid cylinder 55 a contact means 63 is supported.

Guide means 54 is provided in order to make it easier to mount the bobbin B on the supporting means 52 and 53. It has an outside diameter which is slightly smaller than the inside diameter of the bobbin B.

The supporting means 53 is supported on the dead axle 4' with bearings 64 and 65, and is driven by the pulley 14 and the belt 15. On the other hand, an elastic ring (O-ring) 66 and a pin 67 are provided in the part where the bobbin B is supported. While the elastic ring 66 supports the bobbin B by pressing against its inside wall, the pin 67 is plunged into the end of the bobbin, thereby uniting the supporting means 53 and the bobbin B tightly so that the bobbin B may revolve with the supporting means.

In the operation of the aforesaid bobbin-supporting device, when fitting the bobbin B on the supporting means, air is supplied through the bore 34 to air at an end of the revolving arm 3. This increases the air pressure in space 68 formed in the supporting means 52. Accordingly, the cylinder 55 and the stopper 56 are moved, overcoming the force of the spring 60, in the direction of the arrow A, thereby losing the force which pushes against the contact means 63 so as to expand it. As a consequence shrinkage occurs in the outside diameter of the contact means 63 from the contraction of an elastic ring (O-ring) 69. At this stage, the bobbin B is mounted. Thereafter, the air is exhausted from space 68. This causes the cylinder 55 and the stopper 56 to move in the direction opposite to that of arrow A, by the action of the spring 60. Consequently, contact means 63 is pushed by the cam action of cylinder 55 and the cam 62 and strongly presses against the inside wall of bobbin B. This unites the bobbin B and the supporting means 52 very tightly.

The other end of bobbin B is supported by supporting means 53, and the bobbin B revolves lightly on the dead axle 4', driven by the pulley 14.

Figure 10:
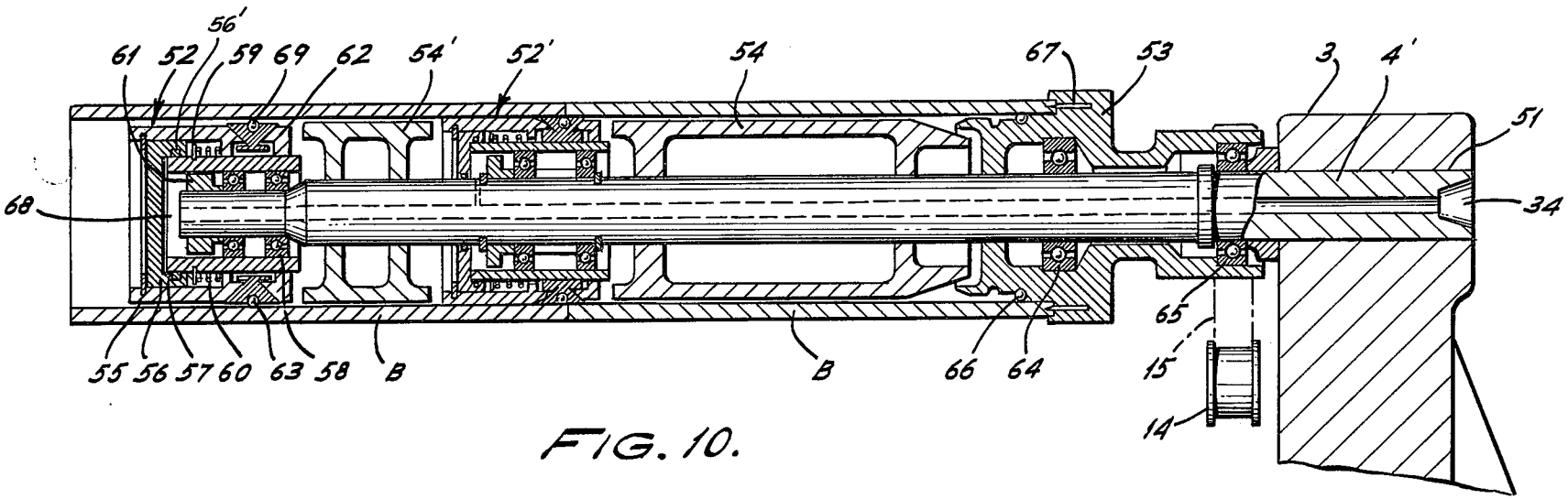

FIG. 10 is a transverse sectional view of an example of a device for supporting a plurality of bobbins. On the dead axle 4' are provided supporting means 52, 52' and 53. Between these supporting means are provided guide means 54 and 54'. These supporting means 52 and 52' act in the same manner and perform the same function. The cylinder 55 is moved axially by fluid pressure to cause shrinkage in the outside diameter of the contact means on which the O-ring 69 is mounted, while movement under the action of the spring 60 causes expansion of the outside diameter of the contact means.

When in this manner a plurality of supporting means are provided on a supporting body, it is possible to support two or more bobbins simultaneously.

An important point in the construction of the bobbin-supporting device according to the present invention is that the bobbin B is supported by the supporting means 52 and 53; and, as occasion demands, one or more supporting means may be added between said two supporting means.

When, therefore, there has been a modification of the length of bobbins to be used, either longer or shorter, it is possible to make the bobbin-supporting device ready for use with new bobbins by merely changing the length of the dead axle 4'.

It is worth particular mention that, in the present invention, it is possible to use supporting means 52 and 53 of certain fixed shapes irrespective of the lengths of the bobbins. Accordingly, bobbins of various kinds can be handled with the use of the same parts, with only a modification of the length of the dead axle 4'. Therefore, it is easy to change products or packages, and it is possible at the same time to reduce the cost of manufacturing the winder greatly.

Furthermore, since the dead axle 4' is fitted to the revolving arm 3, which is the supporting body, like the example described in the foregoing, the revolving part is made much smaller in size.

Further, the bobbin-supporting device in the present invention may as well be applied to a friction drive winding machine wherein the bobbin is rotated by the pressure of a friction roller which rotates at a certain speed.

The present invention is also applicable when a plurality of bobbins are supported on a dead axle 4', as is shown in FIG. 10.

We claim:

1. In a yarn winding apparatus for the continuous winding of a single end of yarn including a revolving mechanism carrying a plurality of spindles wherein each spindle is adapted to carry a bobbin, yarn catching means associated with said bobbin for catching yarn for winding thereon, and wherein means are provided for rotating said revolving mechanism so that an end can be shifted from a full bobbin to an empty bobbin, the combination which comprises:

(a) a plurality of intermediate shafts, each shaft installed concentrically with the axis of rotation of fais revolving mechanism, each shaft connected to one of said spindles;

(b) drive means including independent sources of power, each source connected to one of said shafts so that said spindles are individually driven, each of said power sources being positioned at the back of said revolving mechanism, and each of said spindles being positioned at the front of said revolving mechanism, said intermediate shafts extending from said front to said back;

(c) a plurality of dead axles, each of said dead axles attached to the front of said revolving mechanism and supporting one of said spindles; and (d) shifting means comprising support means, a traverse fulcrum guide means and a travelling yarn guide means positioned on said support for automatically guiding the yarn from a full bobbin to an empty bobbin, means for moving said travelling yarn guide along a predetermined path surrounding said fulcrum guide and said spindles along the exterior of said winder so as to cross the path of yarn extending to the full bobbin, said traverse fulcrum guide consisting of a fixed conical member and a rotating member only so positioned relative to the travelling guide so as to catch at a predetermined point, only the yarn extending from the travelling guide to the full bobbin, whereby when the travelling guide reaches a predetermined position above said revolving mechanism, said mechanism is actuated and rotated to shift from a full to an empty bobbin so that the yarn is picked up by the yarn catching means for winding on the empty bobbin.

2. A yarn winding apparatus according to claim 1 wherein each of said dead axles has an air supply bore extending axially therethrough, and wherein air actuated contact means for releasing a bobbin are connected to each of said dead axles.

3. A yarn winding apparatus according to claim 2 wherein said air actuated contact means further includes a compression spring to expand said contact means in the radial direction when said contact means are not actuated by an air supply.

4. A yarn winding apparatus according to claim 2 wherein said air actuated contact means include an air cylinder which is mounted on each of said dead axles.

5. A yarn winding apparatus according to claim 4 further including an air nozzle disposed in one of said air supply bores, said nozzle to supply a compressed fluid to said contact means, said nozzle also limiting rotational movement of said revolving mechanism.

6. A yarn winding apparatus as recited in claim 1 wherein the yarn is grasped by said traveling yarn guide at a predetermined point during travel of said traveling yarn guide along said predetermined path including fixed guide means on said support means for guiding the yarn running through said traveling yarn guide.

7. A yarn winding apparatus according to claim 6 wherein an empty bobbin contacts the yarn running between said traverse fulcrum guide and said traveling yarn guide.

* * * * *